US005984075A

United States Patent [19]

Schwarzli

[11] Patent Number: 5,984,075

[45] Date of Patent: Nov. 16, 1999

[54] BULK VENDER BASE WITH REMOVABLE CASH BOX

[75] Inventor: Josef W. Schwarzli, Stouffville, Canada

[73] Assignee: Machine-O-Matic Limited, Newmarket, Canada

[21] Appl. No.: 08/929,403

[22] Filed: Sep. 15, 1997

[30] Foreign Application Priority Data

Jun. 3, 1997 [CA] Canada ..... 2206733

[51] Int. Cl.[6] ..... G07F 9/06

[52] U.S. Cl. ..... 194/350

[58] Field of Search ..... 194/350; 232/15, 232/16

[56] References Cited

U.S. PATENT DOCUMENTS 3,390,753 7/1968 Bolen et al. ..... 194/350

5,129,501 7/1992 Halsey et al. ..... 194/350

5,351,856 10/1994 Laidlaw ..... 194/350

5,467,858 11/1995 Kovens et al. ..... 194/350

*Primary Examiner*—Christopher P. Ellis

*Assistant Examiner*—Bryan Jaketic

*Attorney, Agent, or Firm*—Dimock Stratton Clarizio; Mark B. Eisen

[57] ABSTRACT

The invention provides a base for a vending machine having a removable cash box slidably received within the base for receiving coins or tokens deposited by the coin mechanism into the base compartment. In the preferred embodiment the base includes a base frame having a reinforcing bridge bracing the front and rear portions of the base frame. The bridge resists deformation of the base frame, provides a secure structure for receiving the latch from the box lock, and provides a means elevated above the base floor for affixing a center rod which secures the components of the vender together, allowing the cash box to occupy virtually the entire floor area of the base.

20 Claims, 4 Drawing Sheets

BULK VENDER BASE WITH REMOVABLE CASH BOX

FIELD OF INVENTION

This invention relates to vending machines. In particular, this invention relates to a bulk vender having a removable cash box.

BACKGROUND OF THE INVENTION

Vending machines are popular for many merchandise-dispensing applications. In particular, bulk venders, colloquially known as "gum ball machines", are widely used for dispensing gum balls and other small articles. Bulk venders are intended particularly for use in unsupervised public areas, and as such must be designed to resist tampering, theft and vandalism.

A typical bulk vender has a hopper assembly comprising a transparent globe which functions as a merchandise storage bin, seated over a dispensing wheel which revolves in a hopper to dispense a preset amount of merchandise to the user through a dispensing chute. The hopper assembly is located over a body which in turn sits on a base comprising a floor circumscribed by a base frame, defining a secure base compartment. A coin mechanism is mounted in the body, with the coin slot and handle accessible from outside the body of the vender.

The handle can be rotated when one or more coins of the correct denomination, or properly configured tokens, are inserted into the coin slot. This in turn rotates a gear meshing with a toothed edge of the dispensing wheel within the base compartment, such that rotation of the coin mechanism causes the dispensing wheel to revolve and dispense merchandise through a dispensing chute. As the coin mechanism rotates the coin or token is deposited into a cash box protected within the confines of the base compartment. This bulk vender design is well known to those skilled in the art.

In a typical bulk vender the components of the vender are locked together by a center rod affixed to the base floor by threaded engagement into a socket, extending in turn up through the center of the base compartment, the dispensing wheel and the globe and locked into a tubular lock that threads onto the end of the center rod and nests in a central recess provided in the top, effectively securing all components of the vender together between the base and the top.

In order to change or replenish merchandise in the globe only the lock and the top need to be removed, exposing the top opening of the globe. However, to empty the cash box from within the secure base compartment it is necessary to remove the lock, the top and the entire hopper assembly, exposing the open top of the body. This is a time consuming task and, particularly where the globe is relatively well stocked with merchandise, these components can be quite heavy and difficult for an operator to handle.

In some situations there may not be a convenient location to stow these components while the cash box is being emptied. Moreover, removing and replacing the hopper assembly while the globe is stocked with merchandise can damage the merchandise, as the center rod (which has a threaded upper end to engage the lock) abrades against the merchandise in the globe.

Further, because the center rod extends fully to the base floor centrally within the base compartment, there is a limited amount of room available within the base compartment for a removable cash box. A removable cash box must be dimensioned to occupy less than one-half of the floor area of the base compartment, so that it can be easily removed, emptied and replaced without interfering with the center rod. As such, most of the space within the base compartment goes unused. The small size of the cash box substantially limits the number of coins or tokens which the cash box can hold, and as the cash box fills to capacity coins or tokens can pile up and block the coin ejection portion of the coin mechanism, causing it to jam. This means that the vender must be serviced frequently, increasing the cost to the operator.

It would thus be advantageous to provide a removable cash box which is accessible from outside the base compartment without having to remove the hopper assembly from the vender. However, because a bulk vender is likely to be situated in a location where its use is unsupervised, such a system must be designed to resist unauthorized access into the base compartment. Merely providing an opening in the body or the base would reduce the structural integrity of the vender and compromise the security of the base compartment.

It would also be advantageous to provide a cash box which utilizes as much as possible of the available floor area within the base compartment, to maximize the capacity of the cash box and commensurately decrease the frequency of servicing required for the vender.

SUMMARY OF THE INVENTION

The present invention overcomes these disadvantages by providing a bulk vender with a removable cash box accessible from outside the vender base, which locks into a closed position and can be unlocked and removed to be emptied of coins or tokens.

The invention accomplishes this by providing a base frame with an opening along one face for insertion and removal of the cash box. In the preferred embodiment a reinforcing bridge braces the front of the base frame to the back of the base frame, to resist deformation of the base frame, provide a secure structure into which the cash box lock can latch and to provide a means for affixing the center rod in a position elevated above the base floor. This both ensures that the structural integrity of the vender is maintained and allows the cash box to occupy virtually the entire floor area of the base compartment, which maximizes the number of coins or tokens that can be stored before servicing is required.

The present invention thus provides a vending machine comprising a coin mechanism, for accepting coins or tokens and depositing the coins or tokens into a secure base compartment, a hopper assembly for dispensing a preset amount of merchandise as the coin mechanism accepts one or more coins or tokens, and a base fixed to the hopper assembly by a center rod, comprising a base frame having an opening along one face thereof and defining at least a portion of the base compartment, a removable cash box slidably disposed within the base for collecting coins or tokens deposited by the coin mechanism, a lock for locking the cash box into the base, and a bridge to which the center rod is engaged extending across the base compartment, elevated above a bottom of the base compartment to allow clearance for the cash box.

The present invention further provides a base for a vending machine having a coin mechanism for accepting coins or tokens and conveying the coins or tokens into a secure base compartment, and a hopper assembly for dispensing a preset amount of merchandise as the coin mechanism accepts one or more coins or tokens, affixed to the base by a center rod, the base comprising a base frame having an opening along one face thereof and defining at least a portion of the base compartment, a removable cash box slidably disposed within the base for collecting coins or tokens deposited by the coin mechanism, a lock for locking the cash box into the base, and a bridge to which the center rod is engaged extending across the base compartment, elevated above a bottom of the base compartment to allow clearance for the cash box.

BRIEF DESCRIPTION OF THE DRAWINGS

In drawings which illustrate by way of example only a preferred embodiment of the invention.

DETAILED DESCRIPTION OF THE INVENTION

Figure 1:
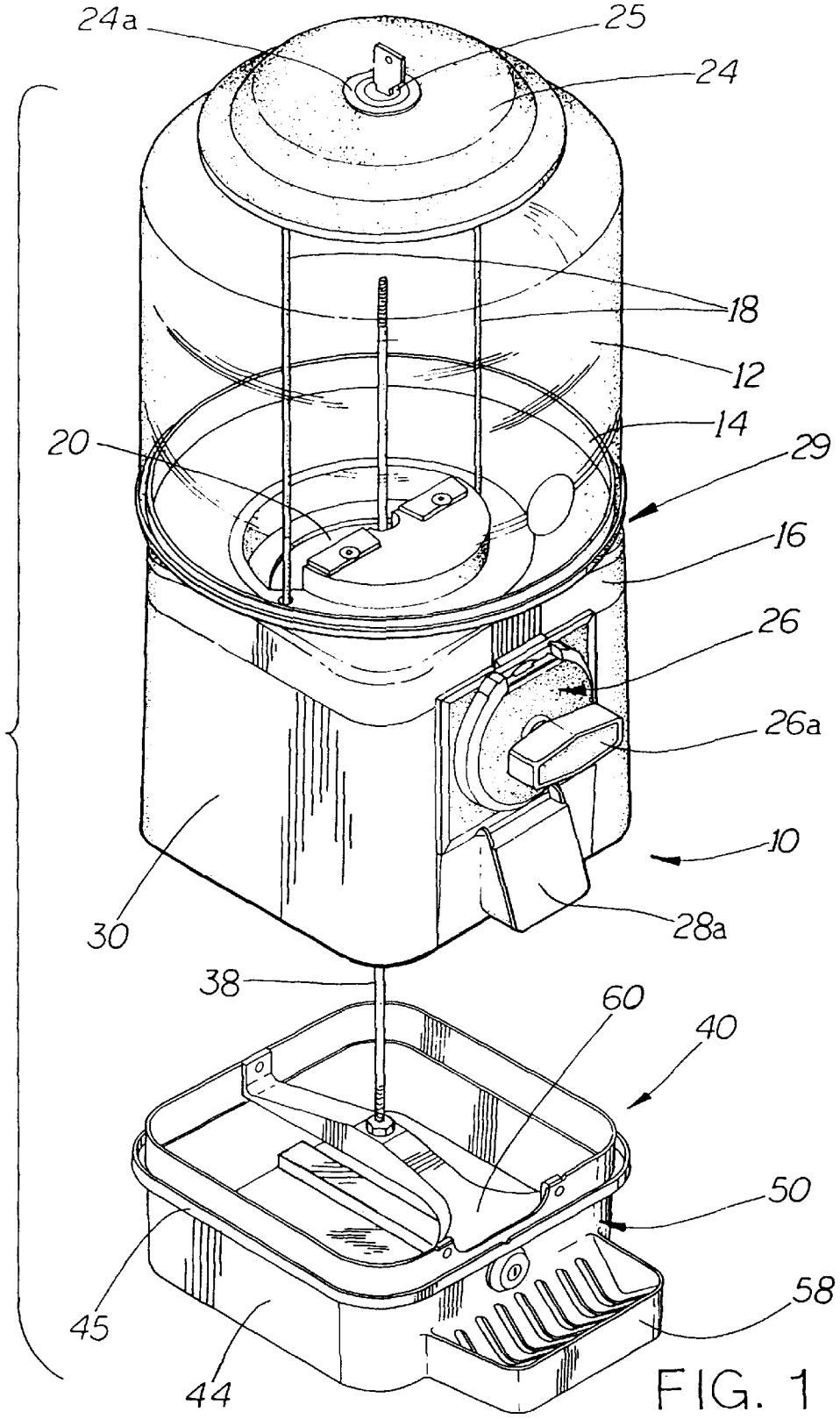
FIG. 1 is a partially exploded perspective view of a bulk vender embodying a preferred embodiment of the invention.

FIG. 1 illustrates by way of example a bulk vender 10 embodying the invention. The vender 10 comprises a transparent globe 12 which stores the merchandise to be dispensed, having a top opening concealed by a top 24 to prevent unauthorized access to the merchandise stored in the globe 12. The globe 12 is seated on a collar 14 which nests in a hopper 16 in which the dispensing wheel 20 revolves. The hopper 16, collar 14 and globe 12 are secured together as a unitary hopper assembly 29, by bolts 18 extending through a retaining ring (not shown) clamping the globe 12 to the hopper 16.

The hopper assembly 29 sits on a body 30, which is typically a unitary plastic casing having an open top and bottom and a notch into which the coin mechanism 26 is slidably mounted, disposed above a dispensing chute 28 molded integrally with the body. The dispensing chute 28 is positioned beneath a dispensing opening (not shown) in the dispensing wheel 20, to convey vended articles to the user through swinging door 28*a*. The coin mechanism 26 is retained in position within the notch by the hopper 16. The coin mechanism 26 is oriented such that a dispensing gear (not shown) meshes with a toothed edge of the dispensing wheel 20, thus rotating the dispensing wheel 20 as the handle 26*a* of the coin mechanism 26 is turned. As the handle 26*a* is turned the coin mechanism 26 deposits the inserted coins or tokens into a secure base compartment defined within the body 30 and a base 40.

The bulk vender described thus far is conventional and well known to those skilled in the art.

The invention provides a removable cash box 50 which is disposed within the secure base compartment when in use, but is accessible from outside of the base 40 for removal and emptying of its contents.

Figure 2:
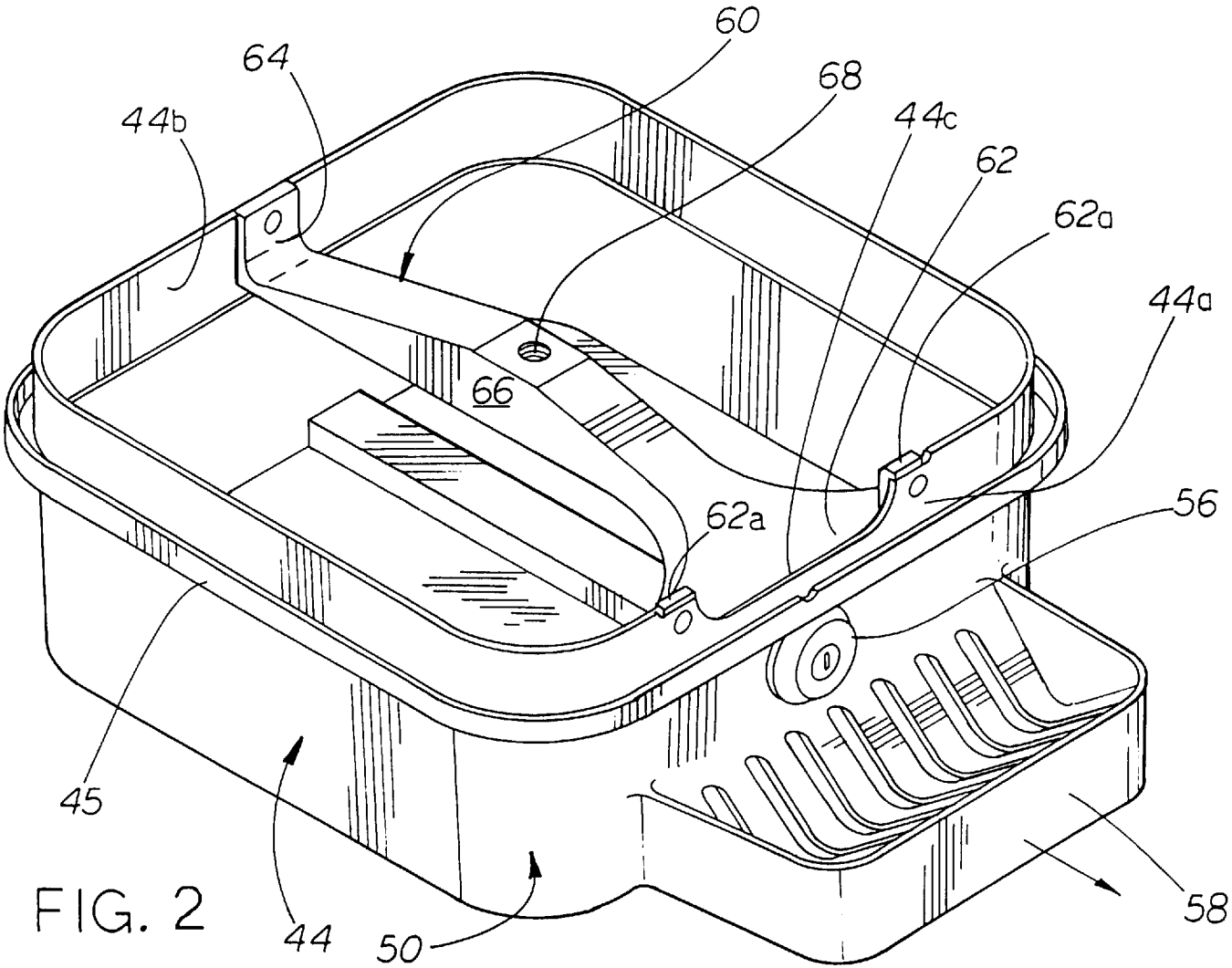
FIG. 2 is a perspective view of the base of the bulk vender of FIG. 1 with the cash box in a closed position.
Figure 3:
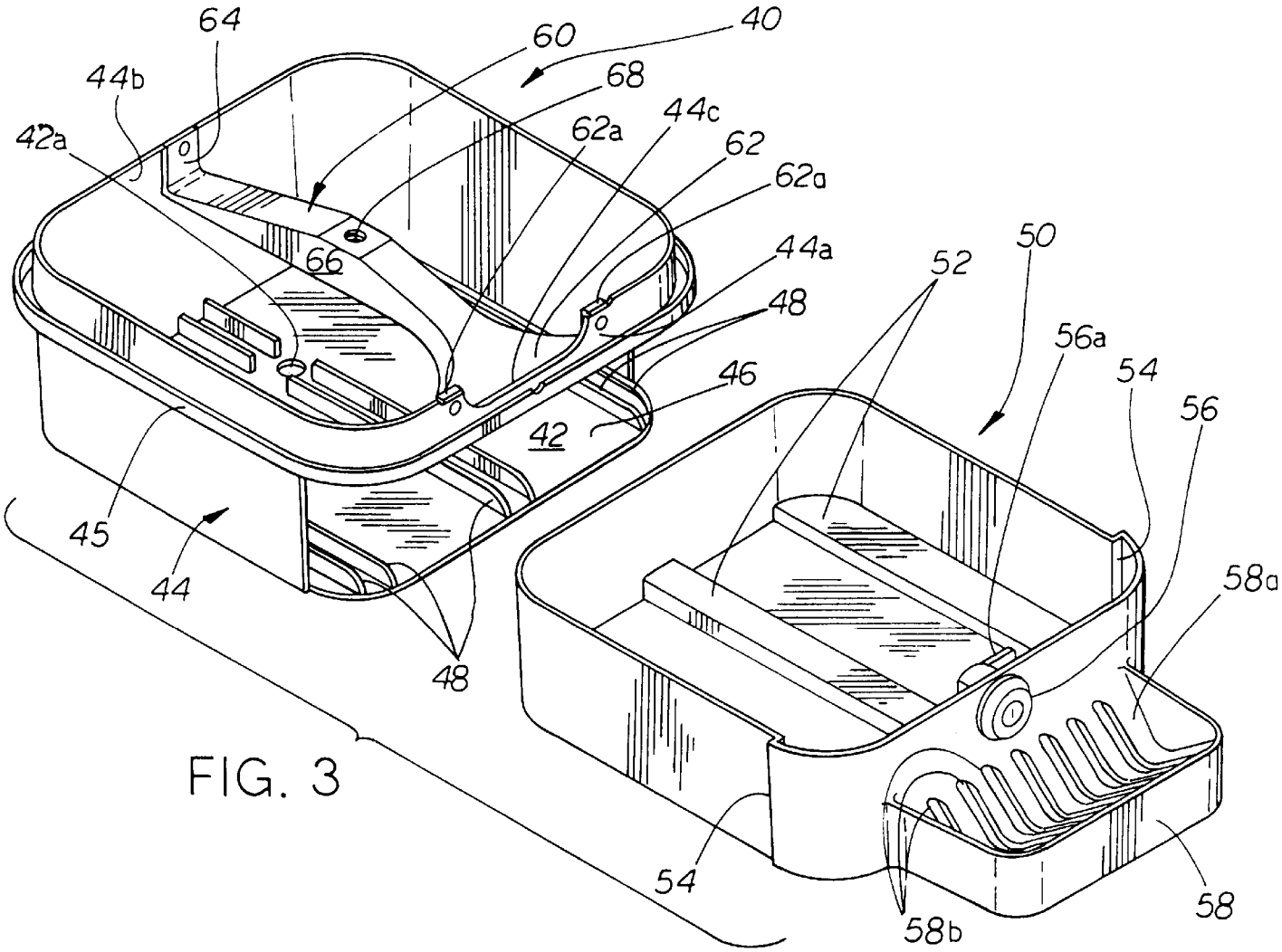
FIG. 3 is a perspective view of the base of the bulk vender of FIG. 1 with the cash box in an open position.

The base 40, illustrated in detail in FIGS. 2 to 5, comprises a floor 42 circumscribed by a base frame 44 provided with a lip 45 which creates a channel into which the body 30 nests in the assembled vender 10. The cash box 50 is slidably disposed within the base 40, and is inserted through an opening 46 along one face (the front 44*a* in the embodiment illustrated) of the base frame 44, as shown in FIG. 3. The floor may be provided with holes 42*a* through which bolts (not shown) can be disposed to affix the base 40 to a stand, or through which rubber feet (not shown) can be mounted for free-standing venders 10, and raised ridges 48 are provided to allow a clearance for the bolt heads or stems of the rubber feet.

Figure 5:
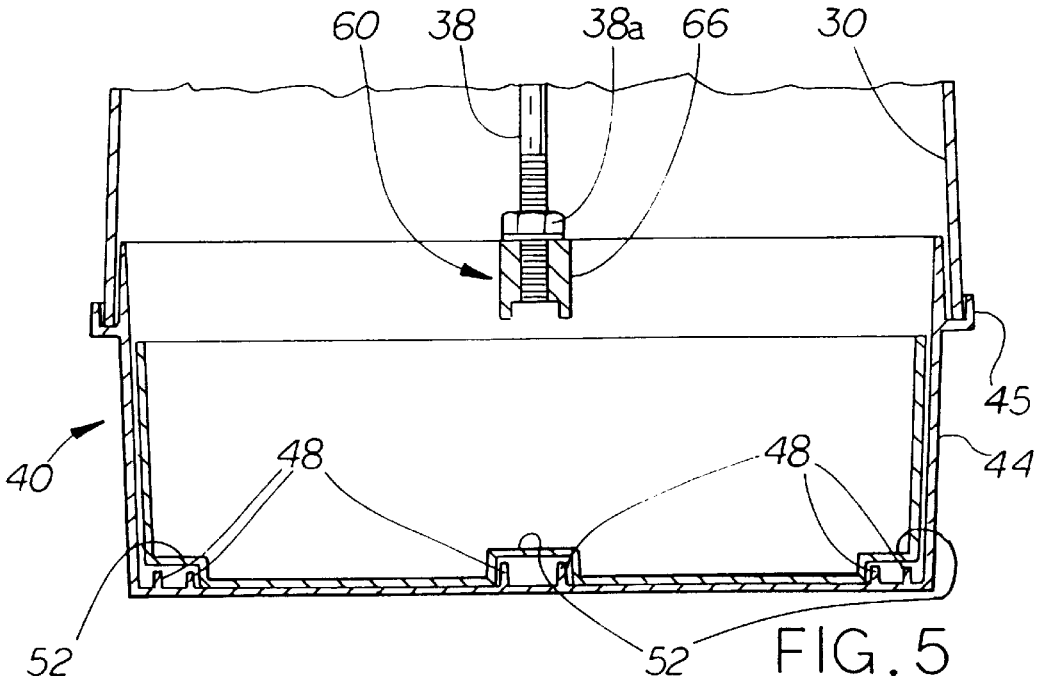
FIG. 5 is a front elevational cross-section of the base of the vender of FIG. 1.

The cash box 50 is provided with channels 52 complimentary to the ridges 48, best seen in FIGS. 3 and 5. Preferably the cash box 50 is configured with shoulders 54 that conform to the shape of the base frame 44, so that in the closed position the base 40 has a uniform appearance, as seen in FIG. 2. This configuration also makes it difficult to insert a tool between the cash box 50 and the base frame 44, thus resisting attempts to pry the cash box 50 out of the base 40. The cash box 50 is provided with a lock 56, and may optionally be provided with a handle 58 which can be conveniently designed with a concave tray 58*a* for gripping when removing and reinserting the cash box 50 and for capturing spillage from the dispensing chute 28 as the user opens the door 28*a* to retrieve their merchandise. The tray 58*a* may be provided with openings such as slots 58*b* for sanitary purposes, to prevent the accumulation of fine food particles within the tray 58*a*.

In the preferred embodiment the base frame 44 is provided with a reinforcing bridge 60 connecting the front 44*a* of the base frame 44 to the back 44*b* of the base frame 44. The bridge 60 is preferably molded as a unitary brace from a strong material such as metal, and has a front wing 62 comprising arms 62*a* for attachment, for example by riveting or any other suitable means, to the front 44*a* of the base frame 44, and a rear wing 64 for attachment in like fashion to the rear 44*b* of the base frame 44. In the embodiment illustrated the front wing 62 generally conforms in shape with a recess 44*c* in which the dispensing chute 28 rests, as shown in FIG. 4.

The bridge 60 in the preferred embodiment has a hollow core defined by sides 66 to resist deformation, but may also be formed as a solid piece from any suitable material. A threaded socket 68 is bored or formed through the center of the bridge 60 for threaded engagement to the center rod 38, and a nut 38*a* can be used to adjust the depth of the center rod 38 in the socket 68, as shown in FIGS. 4 and 5.

Figure 4:
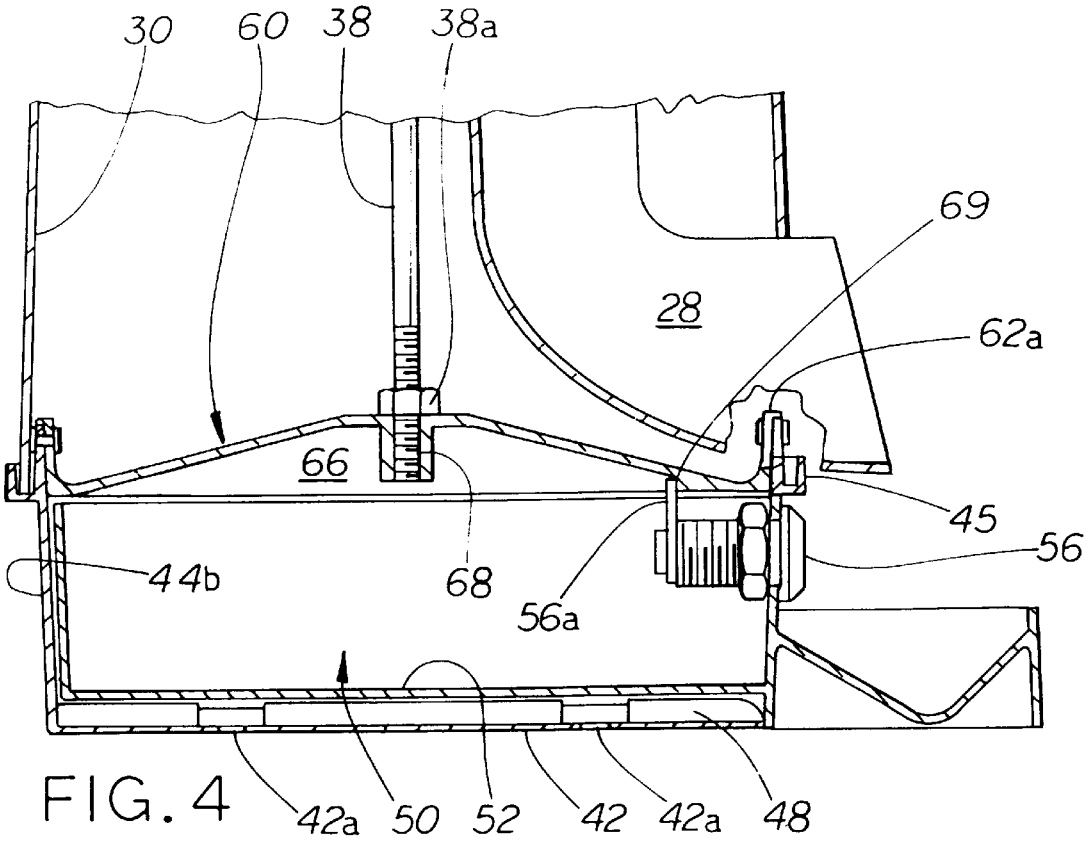
FIG. 4 is a side elevational cross-section of the base of the vender of FIG. 1.

The underside of the bridge 60 is provided with a ledge 69 adjacent to the front wing 62, set back into the base compartment sufficiently that the latch 56*a* of the lock 56 firmly engages the ledge 68 when the cash box 50 is in the fully closed position, as shown in FIG. 4. The wing 62 is wide enough that the latch 56*a* has room to clear the sides 66 of the bridge 60 when rotated into the locked position. If the bridge 60 is formed as a solid piece, a cavity can be provided in the underside of the bridge 60 for receiving the latch 56*a*.

The bridge 60 thus serves to resist deformation of the base frame 44, by providing a brace between the front and rear portions 44*a*, 44*b* of the frame 44, and also provides a secure latch cavity into which the cash box lock 56 can latch, to thus resist attempts to pry the locked cash box 50 out of the base 40 by distributing a prying force to both the front and rear portions 44*a*, 44*b* of the base frame 44. The bridge 60 further provides a means for affixing the center rod 38 in a position elevated above the floor 42, which allows the cash box 50 to occupy virtually the entire floor area of the base compartment, maximizing the capacity of the cash box 50 and commensurately reducing the frequency of servicing required for the vender 10.

In operation, the hopper assembly 29 is assembled in conventional fashion, and the base 40 is locked to the hopper assembly by engaging the centre rod 38 into the threaded socket 68, mounting the hopper assembly 29 over the base 40 such that the center rod 38 extends up through the hopper 16 and the globe 12, placing the top 24 on the globe 12, inserting a tubular lock 25 into the annular lock recess 24*a* provided in the top 24 and engaging the lock 25 to the threaded upper end of the center rod 38. This effectively secures all components of the vender 10 between the base 40 and the top 24.

The assembled vender 10 is located by an operator for vending. As merchandise is dispensed, coins or tokens are deposited into the cash box 50 by the coin mechanism 26. When the cash box 50 nears capacity, service personnel unlocks the lock 56, which rotates the latch 56*a* clear of the ledge 58, and extracts the cash box 50 from the base 40. The cash box 50 can be emptied, replaced into the base 40 and locked for further use, or can be replaced with an empty cash box 50 and taken away by service personnel to be emptied at a subsequent time. The hopper assembly will not have to be removed from the vender except to adjust or replace the dispensing wheel 20 to accommodate a change in merchandise, or to repair the vender 10.

A preferred embodiment of the invention having been thus described by way of example only, it will be apparent to those skilled in the art that the structures and principles of the invention can be applied to many different types and configurations of bulk vender, and the invention is in no way intended to be limited to the specific embodiments shown and described. Without limiting the foregoing, the lock 56 may be oriented so as to latch on to any suitably strong structure associated with the base compartment or may be disposed in the base frame 44 and oriented to latch on to the cash box 50; the cash box 50 may be accessible from any face of the base frame 44, and need not fully occupy the available floor area within the base compartment; the bridge 60 may be oriented to extend from side-to-side, rather than from front-to-back, and will still provide some reinforcement of the base frame structure and a means for affixing the center rod 38 elevated above the base floor 42. The above description describes these and other features in the context of a preferred embodiment of the invention only, and modifications and adaptations may be made without departing from the scope of the invention as set out in the appended claims.

I claim:

1. A vending machine comprising a coin mechanism, for accepting coins or tokens and depositing the coins or tokens into a secure base compartment, a hopper assembly for dispensing a preset amount of merchandise as the coin mechanism accepts one or more coins or tokens, and a base fixed to the hopper assembly by a center rod, comprising a base frame defining at least a portion of the base compartment comprising a floor, side faces, a rear face and a front face, and having an opening along one face thereof, a removable cash box slidably disposed within the base for collecting coins or tokens deposited by the coin mechanism, a lock for locking the cash box into the base frame, and a bridge to which the center rod is engaged extending across the base frame, the bridge being fixed to opposite faces of the base frame at a level above the cash box, whereby the cash box is contained within the base frame in a locked position and may be slidably removed from the base frame through the opening for retrieval of deposited coins or tokens therefrom.

2. The vending machine of claim 1 in which the bridge extends from the front face of the base frame to the rear face of the base frame.

3. The vending machine of claim 2 in which the opening is disposed along a front face of the base frame.

4. The vending machine of claim 3 in which the bridge provides a surface against which a latch of the lock engages when the cash drawer is in the locked position.

5. The vending machine of claim 1 in which the center rod is engaged to the bridge by engagement into a threaded socket disposed generally centrally in the bridge.

6. The vending machine of claim 2 in which the front portion of the base frame includes a recess into which a dispensing chute rests, and the bridge comprises a front wing affixed to the base frame about the recess.

7. The vending machine of claim 1 in which the cash box is provided with shoulders which conform to a configuration of the base.

8. The vending machine of claim 1 in which the floor of the base comprises upstanding ridges providing a clearance for mounting bolts or feet, and the cash box comprises a floor with channels complimentary to the ridges.

9. The vending machine of claim 1 in which a front face of the cash box is provided with a handle comprising a concave tray.

10. The vending machine of claim 4 in which the bridge comprises a brace defined by sides, a top having a threaded socket disposed generally centrally therein for engaging the center rod, a rear end affixed to the rear face of the base frame and a front end affixed to the front face of the base frame, the front end having a ledge in alignment with a latch of the lock whereby the latch engages against the ledge when the cash box is in the locked position.

11. A base for a vending machine having a coin mechanism for accepting coins or tokens and conveying the coins or tokens into a secure base compartment, and a hopper assembly for dispensing a preset amount of merchandise as the coin mechanism accepts one or more coins or tokens, affixed to the base by a center rod, the base comprising a base frame defining at least a portion of the base compartment comprising a floor, side faces, a rear face and a front face, and having an opening along one face thereof, a removable cash box slidably disposed within the base for collecting coins or tokens deposited by the coin mechanism, a lock for locking the cash box into the base frame, and a bridge to which the center rod is engaged extending across the base frame, the bridge being fixed to opposite faces of the base frame at a level above the cash box, whereby the cash box is contained within the base frame in a locked position and may be slidably removed from the base frame through the opening for retrieval of deposited coins or tokens therefrom.

12. The vending machine base of claim 11 in which the bridge extends from a front portion of the base frame to a rear portion of the base frame.

13. The vending machine base of claim 12 in which the opening is disposed along a front face of the base frame.

14. The vending machine base of claim 13 in which the bridge provides a surface against which a latch of the lock engages when the cash drawer is in the locked position.

15. The vending machine base of claim 11 in which the center rod is engaged to the bridge by engagement into a threaded socket disposed generally centrally in the bridge.

16. The vending machine base of claim 12 in which the front portion of the base frame includes a recess into which a dispensing chute rests, and the bridge comprises a front wing affixed to the base frame about the recess.

17. The vending machine base of claim 11 in which the cash box is provided with shoulders which conform to a configuration of the base.

18. The vending machine base of claim 11 in which the floor of the base comprises upstanding ridges providing a clearance for mounting bolts or feet, and the cash box comprises a floor with channels complimentary to the ridges.

19. The vending machine base of claim 11 in which a front face of the cash box is provided with a handle comprising a concave tray.

20. The vending machine base of claim 14 in which the bridge comprises a brace defined by sides, a top having a threaded socket disposed generally centrally therein for engaging the center rod, a rear end affixed to the rear face of the base frame and a front end affixed to the front face of the base frame, the front end having a ledge in alignment with a latch of the lock whereby the latch engages against the ledge when the cash box is in the locked position.

* * * * *